US005210369A

United States Patent [19]

Cassidy

[11] Patent Number: 5,210,369

[45] Date of Patent: May 11, 1993

[54] SELF-ACTUATING SLIDE VALVE SYSTEM

[75] Inventor: James Cassidy, Wakefield, R.I.

[73] Assignee: The United States of America as represented by the Secretary of the Navy, Washington, D.C.

[21] Appl. No.: 912,954

[22] Filed: Jul. 8, 1992

[51] Int. Cl.[5] ..... F41F 3/10

[52] U.S. Cl. ..... 89/1.81; 114/238

[58] Field of Search ..... 89/1.81, 1.809; 114/238, 319

[56] References Cited

U.S. PATENT DOCUMENTS

| | | | |
|---|---|---|---|
| 1,526,256 | 2/1925 | Techel | 114/238 |
| 2,848,970 | 8/1958 | Gunning | 114/238 |
| 4,523,538 | 6/1985 | Hollmann et al. | 114/238 |
| 4,527,502 | 7/1985 | Schmitt | 114/319 |
| 4,848,210 | 7/1989 | Bissonnette | 89/1.81 |
| 5,085,122 | 2/1992 | Berlam et al. | 89/1.81 |
| 5,099,745 | 3/1992 | Hubbell et al. | 89/1.81 |

*Primary Examiner*—David H. Brown
*Attorney, Agent, or Firm*—Michael J. McGowan; Prithvi C. Lall; Michael F. Oglo

[57] ABSTRACT

A self-actuating slide valve system for launching a device in a fluid environment is provided. An interior channel, in which the device is positioned, is provided with first and second openings in its radial walls for allowing the passage of pressurized fluid into the interior channel. The first opening is located at least partially behind a tail end of the device and the second opening is located forward of the first opening. A sleeve is slidably fitted within a portion of the interior channel and around at least a portion of the device. The sleeve is movable between at least a first and second position. In the first position, the sleeve prevents the pressurized fluid from entering the interior channel through the first opening. In the second position, the sleeve allows the pressurized fluid to enter the interior channel through the first opening whereby the pressurized fluid can act on the tail end of the device to launch same through an axial opening of the interior channel. In this way, the interior channel, the sleeve and the circumferential extremity define a holding volume in communication with the second opening that is: (1) supplied with the pressurized fluid to maintain the sleeve in its first position and, (2) evacuated of the pressurized fluid to permit the sleeve to attain its second position.

8 Claims, 1 Drawing Sheet

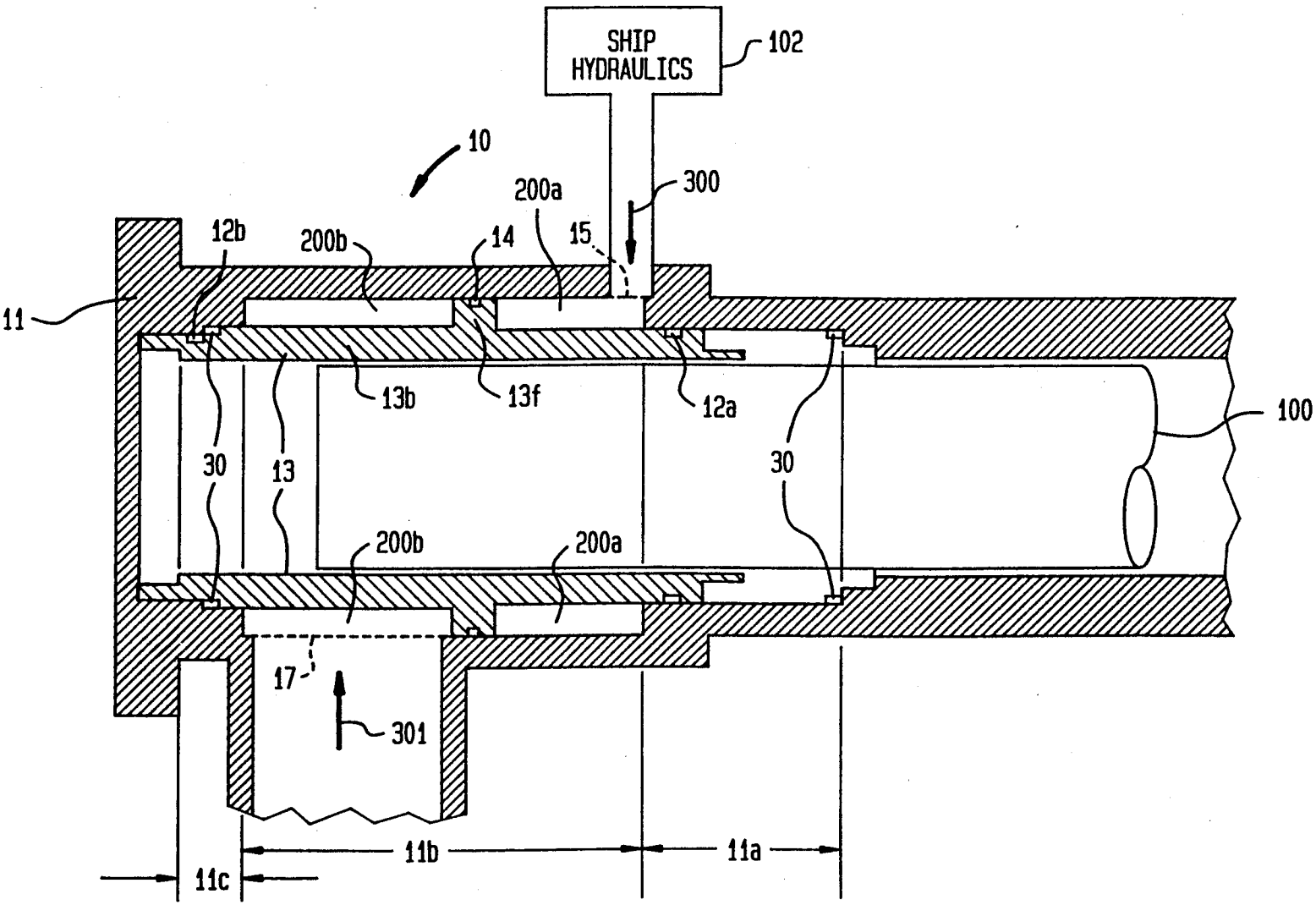
100
102
SHIP
HYDRAULICS
300
15
200a
14
10
200b
12b
11
12a
13f
13b
13
30
30
200a
200b
301
17
11a
11b
11c

SELF-ACTUATING SLIDE VALVE SYSTEM

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates generally to slide valves and more particularly to a self-actuating slide valve system for launching a device in a fluid environment.

(2) Description of the Prior Art

Torpedo tube systems typically inject pressurized water into the breech end of a torpedo tube as the propulsion force used to fire a projectile from the torpedo tube. Prior to firing, the pressurized water is held in abeyance by a valve whose opening and closing thereof is typically controlled by hydraulic cylinders powered by a ship's hydraulic system. In general terms, the hydraulic cylinders serve as the valve's actuator. However, the use of such an actuator delays the opening of the valve thereby increasing the amount of time required to fire the projectile. It is essential to accelerate the projectile as quickly as possible through the shutterway and ship's boundary layer faster than current ship speed.

SUMMARY OF THE INVENTION

Accordingly, it is an object of the present invention to provide a self-actuating valve system for launching a projectile from a torpedo tube.

Another object of the present invention is to provide a self-actuating valve system that opens more quickly than valves requiring an actuator.

Still another object of the present invention is to provide a self-actuating valve system that makes use of available pressurized water from a ship's hydraulic ejection system.

Other objects and advantages of the present invention will become more obvious hereinafter in the specification and drawing.

A self-actuating slide valve system for launching a device in a fluid environment is provided. An interior channel, in which the device is positioned, is successively defined from fore (muzzle) to aft (breech) by first through fourth sections. The first section has a first inside diameter suitable for passage of the device in a fluid tight relationship. The second section has a second inside diameter larger than the first inside diameter, the third section has an inside diameter larger than the second inside diameter, and the fourth section has a fourth inside diameter equal to the second inside diameter. The interior channel means is further provided with first and second openings in radial walls of the third section. The first opening is located at least partially behind a tail end of the device and the second opening is located forward of the first opening. Pressurized ejection fluid is provided to the interior channel through the first opening. Pressurized holding fluid is provided to the interior channel of the second opening. A sleeve, spanning the third section, is slidably fitted within the interior channel defined by the second diameter. The sleeve is further positioned around at least a portion of the device such that a holding volume is formed in the third section between the sleeve and the interior channel. The sleeve is movable within the interior channel such that in a first position, the sleeve prevents the pressurized fluid from entering the interior channel through the first opening. In a second position, the sleeve allows the pressurized fluid to enter the interior channel through the first opening whereby the pressurized fluid can act on the tail end of the device to launch same through an axial opening of the interior channel. The sleeve further has a circumferential flange in fluid sealed engagement with an inside circumference of the interior channel between the first and second openings. The inside circumference is defined by the third diameter such that the flange divides the holding volume into a forward holding volume in communication with the second opening and an aft ejection volume in communication with the first opening. The forward holding volume is isolated from the aft ejection volume whereby the forward holding volume is: (1) first position and, (2) evacuated of the pressurized fluid to permit the sleeve to attain its second position.

BRIEF DESCRIPTION OF THE DRAWINGS

The sole FIGURE is a cross-sectional view of a self-actuating slide valve system according to the present invention as it is installed in a torpedo tube.

DESCRIPTION OF THE PREFERRED EMBODIMENTS

Referring now to the drawing, the self-actuating slide valve system is shown in cross-section, and is referred to generally by the numeral 10. System 10 is essentially installed in the aft end of a generally cylindrical torpedo tube 11. Accordingly, only the aft end of torpedo tube 11 is shown. A projectile or torpedo 100 (only the aft or tail end of which is shown) is coaxially positioned within torpedo tube 11. Torpedo tube 11 is shown configured to support an ejection type launch. Specifically, this means that the inside diameter of torpedo tube 11 is such that torpedo 100 is able to pass through tube 11 and yet maintain a fluid tight relationship with tube 11. Alternatively, torpedo tube 11 may be configured for a swimout launch. In such a case, the inside diameter of tube 11 would be larger than the diameter of torpedo 100 to allow fluid to flow freely around torpedo 100. It is to be appreciated that while the present invention will be described for an ejection launch configuration, the inventive aspects are applicable to either type of launch configuration.

System 10 consists essentially of the aft end of torpedo tube 11 and a sleeve-like, slide valve 13 slidably fitted within the aft end of torpedo tube 11 as shown. Specifically, slide valve 13 is composed of a generally cylindrical body portion **13*b* and an integral flange portion 13*f*. For the ejection launch configuration being described, slide valve body portion 13*b* has an inside diameter that is equal to the inside diameter of torpedo tube 11 as described above. Accordingly, slide valve body portion 13*b* must be fitted within a section of torpedo tube 11 residing between the lines indicated by reference numeral 11*a*. Section 11*a* has an inside diameter that is larger than that of torpedo tube 11 to accommodate the thickness of body portion 13*b***.

Flange portion **13*f* is a circumferential flange that positions the slide valve body portion 13*b* around torpedo tube 11. Accordingly, another section 11*b* of torpedo tube 11 must be provided with an inside diameter that is large enough to accept the outside diameter of the circumferential flange portion 13***f* and the thickness of body portion 13*b*. For reasons that will be more fully described hereinbelow, this larger diameter section 11*b* accommodating flange portion 13*f*, extends along a length of torpedo tube 11. Furthermore, the length of slide valve body portion 13*b* must be long enough such that, in a first position as shown, body portion 13*b* spans the length of this larger diameter section 11*b*. In order to form a seal around the aft end of torpedo 100 between the larger diameter section 11*b* and slide valve body portion 13*b*, the aft end of body portion 13*b* (in the shown first position) is fitted within a section 11*c* of torpedo tube 11. Section 11*c* has an inside diameter equivalent to that of section 11*a* in order to maintain slide valve 13 in coaxial alignment with torpedo 100.

Flange portion 13*f* divides a formed volume between torpedo tube 11 and slide valve 13 into two isolated volumes 200*a* and 200*b*. Volume 200*a* is a holding volume forward of volume 200*b* which is an ejection volume. A first opening (indicated by dashed lines 15) is provided in larger diameter section 11*b* to communicate with the holding volume 200*a*. A second opening (indicated by dashed lines 17) is provided in larger diameter section 11*b* to communicate with the ejection volume 200*b*. In order to completely isolate holding volume 200*a* from ejection volume 200*b*, a gasket 14 is provided around the circumference of flange portion 13*f*. Gasket 14 is typically an O-ring that provides a fluid sealed engagement with section 11*b* while allowing sliding movement of flange portion 13*f* within section 11*b* as will be described further hereinbelow. Similarly, gaskets 12*a* and 12*b* are provided at either end of slide valve body portion 13*b* to provide slidable, fluid sealed engagement with sections 11*a* and 11*c*, respectively, of torpedo tube 11.

In operation, pressurized fluid (typically seawater) indicated generally by arrow 301, is provided to ejection volume 200*b* via opening 17. Hydraulic fluid, indicated by arrow 300, is provided to holding volume 200*a* via opening 15. Typically, this would be accomplished by the ship's hydraulic system 102. In the shown first position of slide valve 13, the pressures of the fluids indicated by arrows 300 and 301 are such that the pressure in holding volume 200*a* is sufficient to push the aft portion of body portion 13*b* up against section 11*c* of torpedo tube 11. In this way, pressurized fluid indicated by arrow 301 is prevented from passing through opening 17 into torpedo tube 11. When it is time to fire torpedo 100, holding volume 200*a* is evacuated by the ship's hydraulic system 102. In this way, a pressure differential is created between holding volume 200*a* and ejection volume 200*b* such that slide valve 13 is allowed to slide forward as pressurized fluid indicated by arrow 301 pushes against flange portion 13*f*. Simultaneously, pressurized fluid 301 passes through opening 17 behind the tail end of torpedo 100. Thus, pressurized fluid indicated by arrow 301 serves as the propulsion force used to eject torpedo 100 from torpedo tube 11 through an axial opening provided at the forward end of tube 11. Once torpedo 100 has been fired, pressurized fluid indicated by arrow 300 is once again pumped into holding volume 200*a* with a force sufficient to push slide valve 13 back to its first position.

It should be appreciated that only those essential features of the present invention have been enumerated herein in order to provide a clear understanding of same. However, many other conventional features may be incorporated into the inventive design as needed. For example, mechanical noise created at each end of the stroke of sliding valve 13 may be controlled by dashpots 30 positioned in sections 11*a* and 11*c* of torpedo 11 as shown.

The advantages of the present invention are numerous. The self-actuating slide valve system presented herein serves as both a firing valve and actuator. This eliminates the need for any hydraulic actuator and the firing time delay associated therewith. Furthermore, the slide valve is a single moving part and is easily machined to conform to a variety of configurations and sizes.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A self-actuating slide valve system for launching a device in a fluid environment, comprising:

means for forming an interior channel in which the device is positioned, said interior channel means being provided with a first opening and a second opening in radial walls thereof, wherein the first opening is located at least partially behind a tail end of the device and the second opening is located forwardly of the first opening, and wherein pressurized fluid is provided to said interior channel means through the first and second openings; and a sleeve slidably fitted within a portion of said interior channel means and around at least a portion of the device, said sleeve being movable between at least a first and second position where, in the first position, said sleeve prevents the pressurized fluid from entering said interior channel means through the first opening and where, in the second position, said sleeve allows the pressurized fluid to enter said interior channel means through the first opening whereby the pressurized fluid can act on the tail end of the device to launch same through an axial opening of said interior channel means, said sleeve further having a circumferential extremity in fluid sealed engagement with an inside circumference of said interior channel means between the first and second openings such that said interior channel means, said sleeve and said circumferential extremity define a holding volume in communication with the second opening that is: (1) supplied with the pressurized fluid to maintain said sleeve in its first position and, (2) evacuated of the pressurized fluid to permit said sleeve to attain its second position.

2. A system as in claim 1 further comprising means for evacuating the holding volume to permit said sleeve to attain its second position.

3. A self-actuating slide valve system for launching a device in a fluid environment, comprising:

means for forming an interior channel in which the device is positioned, said interior channel means being defined by first, second and third inside diameters, said first inside diameter being suitable for passage of the device in a fluid tight relationship, said second inside diameter being larger than said first inside diameter and said third inside diameter being larger than said second inside diameter, said interior channel means further being provided with first and second openings in radial walls thereof, wherein the first opening is located at least partially behind a tail end of the device and the second opening is located forwardly of the first opening, and wherein pressurized fluid is provided to said interior channel means through the first and second openings; and a sleeve slidably fitted within a portion of said interior channel means defined by said second diameter and positioned around at least a portion of the device, said sleeve being movable between at least a first and second position where, in the first position, said sleeve prevents the pressurized fluid from entering said interior channel means through the first opening and where, in the second position, said sleeve allows the pressurized fluid to enter said interior channel means through the first opening whereby the pressurized fluid can act on the tail end of the device to launch same through an axial opening of said interior channel means, said sleeve further having a circumferential extremity in fluid sealed engagement with an inside circumference of said interior channel means between the first and second openings, said inside circumference being defined by said third diameter such that said interior channel means, said sleeve and said circumferential extremity define a holding volume in communication with the second opening that is: (1) supplied with the pressurized fluid to maintain said sleeve in its first position and, (2) evacuated of the pressurized fluid to permit said sleeve to attain its second position.

4. A system as in claim 3 further comprising means for evacuating the holding volume to permit said sleeve to attain its second position.

5. A system as in claim 3 wherein said sleeve has an inside diameter equal to said first inside diameter.

6. A self-actuating slide valve system for launching a device in a fluid environment, comprising:

means for forming an interior channel in which the device is positioned, said interior channel means being successively defined from fore to aft by first through fourth sections, said first section having a first inside diameter suitable for passage of the device in a fluid tight relationship, said second section having a second inside diameter larger than said first inside diameter, said third section having an inside diameter larger than said second inside diameter, and said fourth section having a fourth inside diameter equal to said second inside diameter, said interior channel means further being provided with first and second openings in radial walls of said third section, wherein the first opening is located at least partially behind a tail end of the device and the second opening is located forward of the first opening, and wherein a first pressurized fluid is provided to said interior channel means through the first opening and a second pressurized fluid is provided to said interior channel means through the second opening; and a sleeve spanning said third section and slidably fitted within said interior channel means defined by said second diameter, said sleeve further being positioned around at least a portion of the device such that a volume is formed in said third section between said sleeve and said interior channel means, said sleeve being movable between at least a first and second position where, in the first position, said sleeve prevents the first pressurized fluid from entering said interior channel means through the first opening and where, in the second position, said sleeve allows the first pressurized fluid to enter said interior channel means through the first opening whereby the first pressurized fluid can act on the tail end of the device to launch same through an axial opening of said interior channel means, said sleeve further having a circumferential flange in fluid sealed engagement with an inside circumference of said interior channel means between the first and second openings, said inside circumference being defined by said third diameter such that said flange divides the volume into a forward holding volume in communication with the second opening and an aft ejection volume in communication with the first opening, wherein the forward holding volume is isolated from the aft ejection volume whereby the forward holding volume is: (1) supplied with the second pressurized fluid to maintain said sleeve in its first position and, (2) evacuated of the second pressurized fluid to permit said sleeve to attain its second position.

7. A system as in claim 6 further comprising means for evacuating the forward holding volume to permit said sleeve to attain its second position.

8. A system as in claim 6 wherein said sleeve has an inside diameter equal to said first inside diameter.

* * * * *